US005896677A

United States Patent [19]

Barsorian

[11] Patent Number: 5,896,677

[45] Date of Patent: Apr. 27, 1999

[54] INTERCHANGEABLE INNER SOLE SYSTEM

[75] Inventor: John Barsorian, Nashua, N.H.

[73] Assignee: Columbia Insurance Company, Omaha, Nebr.

[21] Appl. No.: 08/946,943

[22] Filed: Oct. 9, 1997

Related U.S. Application Data

[63] Continuation of application No. 08/692,585, Aug. 6, 1996, abandoned.

[51] Int. Cl.[6] ..... A43B 13/40; A43B 13/26; A43B 13/00; A43B 3/12

[52] U.S. Cl. ..... 36/11.5; 36/45; 36/25 R; 36/43

[58] Field of Search ..... 36/43, 44, 141, 36/11.5, 25 R, 32 R, 45, 57

[56] References Cited

U.S. PATENT DOCUMENTS

| | | | |
|---|---|---|---|
| 1,730,466 | 10/1929 | Mallot | 36/44 |
| 1,771,793 | 7/1930 | Kind . | |
| 2,106,788 | 2/1938 | Borman | 36/35 |
| 2,365,027 | 12/1944 | Urbany | 36/29 |
| 2,597,393 | 5/1952 | Slampa | 36/35 |
| 2,838,776 | 6/1958 | Tax | 36/11.5 |
| 3,468,040 | 9/1969 | Fukuoka | 36/11.5 |
| 3,595,244 | 7/1971 | Kugler | 36/11.5 |
| 3,664,040 | 5/1972 | Ouimet | 36/25 R |
| 3,707,784 | 1/1973 | Stafford | 36/11.5 |
| 3,890,725 | 6/1975 | Lea et al. | 36/11.5 |
| 4,084,333 | 4/1978 | Del Vecchio | 36/43 |
| 4,188,736 | 2/1980 | Keller | 36/43 |
| 4,348,820 | 9/1982 | D'Alessio | 36/11.5 |
| 4,439,935 | 4/1984 | Kelly | 36/11.5 |
| 4,674,203 | 6/1987 | Göller | 36/44 |
| 4,694,831 | 9/1987 | Seltzer | 36/43 |
| 4,768,295 | 9/1988 | Ito | 36/28 |
| 4,955,148 | 9/1990 | Padilla | 36/44 |
| 5,060,400 | 10/1991 | Finn et al. | 36/11.35 |
| 5,086,574 | 2/1992 | Bacchiocchi | 36/35 |
| 5,092,060 | 3/1992 | Frachey et al. | 36/29 |
| 5,175,946 | 1/1993 | Tsai | 36/29 |
| 5,483,757 | 1/1996 | Frykberg | 36/11.5 |

*Primary Examiner*—Paul T. Sewell
*Assistant Examiner*—Anthony Stashick
*Attorney, Agent, or Firm*—Fish & Richardson P.C.

[57] ABSTRACT

An article of footwear includes an outsole having a bottom walking surface and a depressed top surface surrounded by an upstanding peripheral sidewall having a upper peripheral edge, an upper attached to the outsole, and a replaceable inner sole. The upstanding peripheral sidewall and depressed top surface of the outsole together define a cavity lying generally below the upper peripheral edge. The upper and outsole together define a volume disposed over the cavity and generally above the upper peripheral edge, the volume sized comfortably accommodate a wearer's foot. The replaceable inner sole has a body sized and shaped to fit snugly within the cavity portion, generally removed from encroachment of the volume, while supporting a wearer's foot within the volume.

11 Claims, 3 Drawing Sheets

INTERCHANGEABLE INNER SOLE SYSTEM

This is a continuation of application Ser. No. 08/692,585, filed Aug. 6, 1996, now abandoned.

BACKGROUND OF THE INVENTION

The invention relates to footwear.

A typical shoe or boot includes an outsole which is attached to an upper lasted to an insole. The insole and upper together define a volume for receiving and protecting a wearer's foot. In certain constructions, the insole may be covered by a "sock-lining" formed of leather or synthetic material and inserted within the already-completed shoe. The sock-lining is designed to provide comfort, warmth and support to the wearer's foot. The sock-lining may also be of the type used to combat foot odor. Such sock-linings or other footbeds must be quite thin so as to consume only a relatively small portion of the volume intended for the wearer's foot, thus to avoid adversely affecting shoe fit.

SUMMARY OF THE INVENTION

According to the invention, an article of footwear comprises an outsole having a bottom walking surface and a depressed top surface surrounded by an upstanding peripheral sidewall having an upper peripheral edge, the upstanding peripheral sidewall and the depressed top surface of the outsole together defining a cavity portion lying generally below the upper peripheral edge; an upper attached to the outsole, the upper and outsole together defining a volume disposed over the cavity portion and generally above the upper peripheral edge and sized to comfortably accommodate a wearer's foot; and a replaceable inner sole having a body sized and shaped to fit snugly within the cavity portion, generally removed from encroachment of the volume, while supporting a wearer's foot within the volume. The term "article of footwear" encompasses all different types of footwear including, but not limited to, boots, clogs and sandals.

Preferred embodiments of the invention may include one or more of the following features. The upstanding peripheral sidewall is integrally molded with the outsole. The upper is stitched to the upstanding, peripheral sidewall. The replaceable inner sole defines a support region having a thickness in a range between about ⅛ inch to about ¾ inch, and preferably greater than about ½ inch. Preferably, the support region is disposed in the cavity portion at a position to support a heel and/or arch and/or metatarsal region of the wearer's foot. An upper surface of the replaceable inner sole defines a plurality of discrete raised protuberances for orthotic support of an undersurface region of the wearer's foot. The replaceable inner sole comprises cushioning and/or perspiration-absorbent layers.

Conventional replaceable footbeds, like those used to provide additional support or odor-absorption, are designed to be positioned within any number of different shoes of a given size or range of sizes. However, such conventional footbeds if formed to be too thick will consume a significant portion of the volume of the shoe resulting in an overly tight fit and discomfort to the wearer. The replaceable inner soles of the invention, on the other hand, do not occupy any of the volume normally intended for the wearer's foot, but only that specifically provided for the inner sole. Thus, the shoe can be designed to have a volume which will accommodate an inner sole of any shape, thickness or form, including those inner soles with arch or metatarsal supports and other orthotics.

Advantages of the invention are numerous. For example, various inner soles can be interchanged into the cavity of the shoe to accommodate the particular walking condition within which the shoe is being used. In warm weather conditions, an inner sole having a liner for absorbing or wicking perspiration from the foot may be used. Alternatively, where the wearer expects to be standing or walking for long periods, an inner sole with orthotic support regions may be substituted into the same shoe.

Other advantages and features of the invention will become apparent from the following description of presently preferred embodiments, and from the claims.

BRIEF DESCRIPTION OF THE INVENTION

DESCRIPTION OF THE PREFERRED EMBODIMENTS

Figure 1:
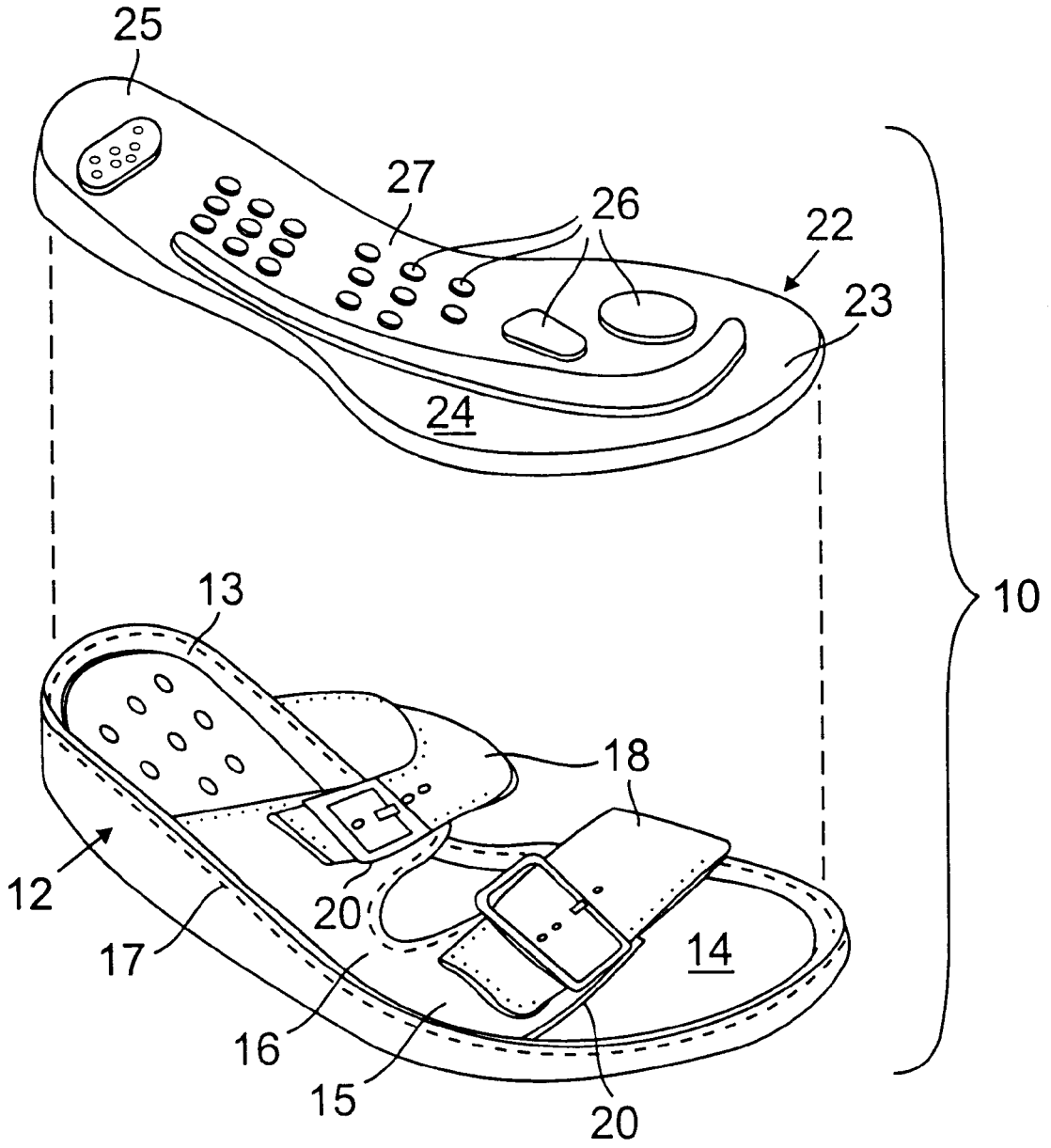
FIG. 1 is a perspective view of an article of footwear (a sandal) and a replaceable inner sole of the invention.

Referring to FIG. 1, an article of footwear, e.g. sandal 10, includes an outsole 12 formed of molded polyurethane with an integrally molded, upstanding sidewall 13 extending around its periphery. The depressed top surface 14 of the outsole and the sidewall 13 together define a cavity having a depth ranging from about ⅛ inch to about ¾ inch. The sandal 10 also has a leather upper 16 joined, e.g. by stitching 17, to the inner surface 15 of the sidewall. In the embodiment shown, the upper 16 has a pair of straps 18 which are adjustably received within buckles 20.

Referring also to FIGS. 2 and 4A–6A, an interchangeable inner sole 22, having a thickness approximating the depth of the cavity, is positioned therein. The inner sole is formed of a material (e.g., polyurethane) having a predetermined density (e.g., commensurate with having a Shore A hardness of 2.8) selected to provide flexible, but relatively firm support to the wearer's foot. In the embodiment shown, inner sole 22 has a toe region 23 having a thickness of about ⅛ inch and a rear region 25 having a thickness of about ¾ inch. The thickness of the inner sole gradually increases in an arch region 27 between the toe and heel regions. Inner sole 22 includes a body 28 and a top layer 24, e.g. of pigskin leather, attached thereto, e.g. with adhesive. The inner sole surface of the top layer has raised areas 26 which provide orthotic support and stimulate various regions of the wearer's foot (e.g., metatarsal regions). Moreover, the raised regions 26 allow air to circulate between the foot and the inner sole upper surface for increased comfort.

Figure 2:
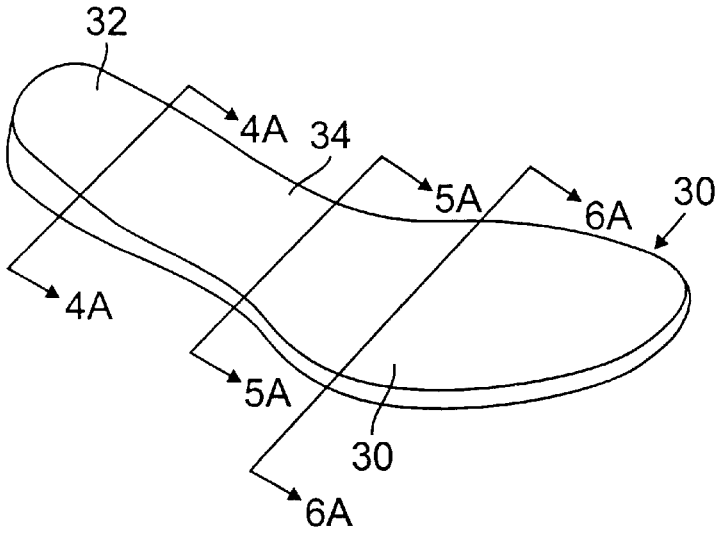
FIG. 2 is a perspective view of another embodiment of a replaceable inner sole which is interchangeable with the inner sole of FIG. 1.

In FIG. 2, another embodiment of an inner sole 30, interchangeable with inner sole 22 of FIG. 1, is shown. In this embodiment, the inner sole 30 has a body 31 formed of polyurethane having a predetermined density selected to be relatively less than that of inner sole 22 (e.g., commensurate with having a Shore A hardness of 2.2) thereby to provide softer and more elastic support for the wearer's foot.

Figure 3:
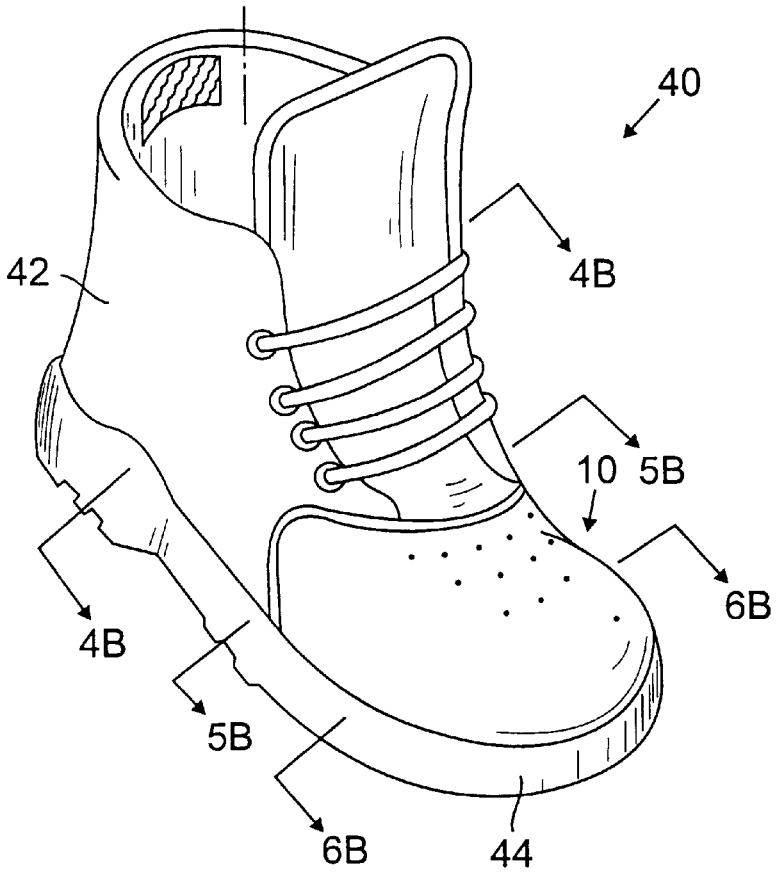
FIG. 3 is a perspective view of another embodiment of an article of footwear having outsole for receiving, e.g. the inner soles of FIGS. 1 and 2, according to the invention.
Figure 4B:
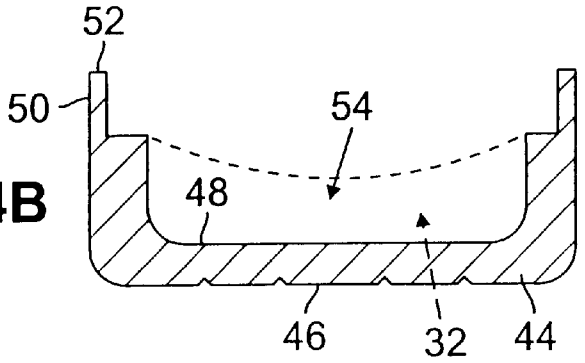
FIG. 4B is corresponding cross-sectional view of the outsole along line 4B—4B of FIG. 3.
Figure 5B:
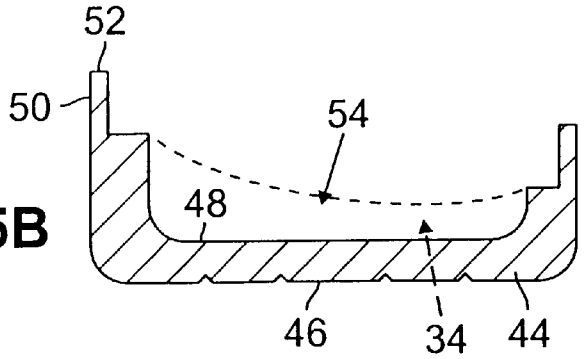
FIG. 5B is corresponding cross-sectional view of the outsole along line 5B—5B of FIG. 3.
Figure 6B:
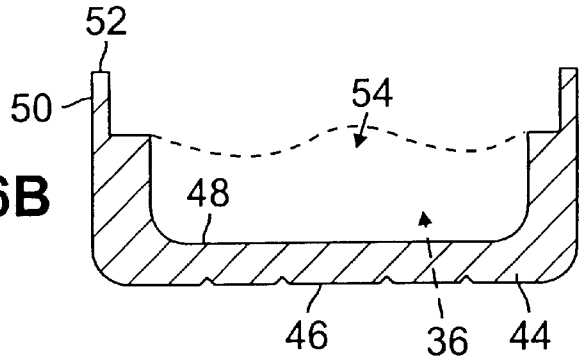
FIG. 6B is corresponding cross-sectional view of the outsole along line 6B—6B of FIG. 3.
Figure 4A:
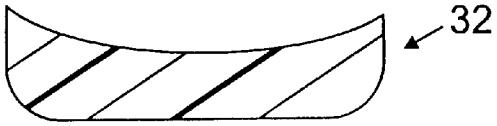
FIG. 4A is cross-sectional view of the inner sole along line 4A—4A of FIG. 2.
Figure 5A:
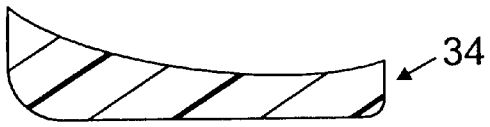
FIG. 5A is cross-sectional view of the inner sole along lines 5A—5A of FIG. 2.
Figure 6A:
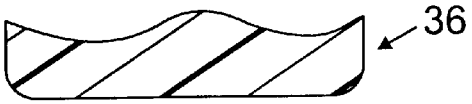
FIG. 6A is cross-sectional view of the inner sole along lines 6A—6A of FIG. 2.

Referring to FIG. 3, in another embodiment, a shoe 40 includes an upper 42 attached to an outsole 44 which together define an inner volume for receiving the wearer's foot as well as inner sole 30 (FIG. 2).

Referring to FIGS. 4A–6A, rear region 32, arch region 34 and metatarsal region 36 of the inner sole 30 are respectively shown in cross section to provide comfort for a wearer's tired foot. Rear region 32 (FIG. 4A) has a concave shape to receive the wearer's heel, arch region 34 (FIG. 5A) defines a raised arch area 38 for increased support, while metatarsal region 36 (FIG. 6A) is raised under the third metatarsal bone. Inner sole 30 has split leather or suede layer 40 attached upon the top surface of body 31, e.g. to absorb perspiration and provide a soft surface to the wearer's foot.

Referring to FIGS. 4B–6B, outsole 44 of shoe 40 (FIG. 3) is shown in cross section along the length of the outsole corresponding to rear region 32, arch region 34 and metatarsal region 36 of the inner sole 30. Outsole 44 has a bottom walking surface 46 and a depressed top surface 48 surrounded by an upstanding peripheral sidewall 50 having an upper peripheral edge 52. The upstanding peripheral sidewall and the depressed top surface of the outsole together define a cavity portion 54 lying generally below the upper peripheral edge. The upper 42 and outsole 44 together define a volume disposed over the cavity portion and generally above the upper peripheral edge 52 which is sized to comfortably accommodate the wearer's foot. The volume also accommodates replaceable inner sole 30 which is sized and shaped to fit snugly within cavity portion 54 and generally removed from encroachment of the volume, while supporting a wearer's foot within the volume.

Other embodiments are within the scope of the claims. For example, although a sandal and shoe have been described above in conjunction with FIGS. 1 and 3, the invention is applicable as well to other types of footwear e.g. boots and clogs.

What is claimed is:

1. An article of footwear comprising:

an outsole including a bottom walking surface, a depressed top surface, and an upstanding peripheral sidewall extending above the top surface and surrounding the depressed top surface, the upstanding peripheral sidewall having an upper peripheral edge, said upstanding peripheral sidewall and said depressed top surface of said outsole together defining a cavity portion lying generally below said upper peripheral edge;

an upper stitched to said upstanding peripheral sidewall of said outsole, said upper and said outsole together defining a volume disposed over said cavity portion and generally above said upper peripheral edge and sized to comfortably accommodate a wearer's foot; and a replaceable inner sole having a body sized and shaped to fit snugly within said cavity portion, the body including a peripheral edge region having a top surface aligned with or substantially below the upper peripheral edge of the upstanding peripheral sidewall of the outsole so that the replaceable inner sole is generally removed from encroachment of said volume disposed over said cavity portion, while supporting a wearer's foot within said volume.

2. The article of footwear of claim 1 wherein said upstanding peripheral sidewall is integrally molded with said outsole.

3. The article of footwear of claim 1 wherein said upper is stitched to said upstanding, peripheral sidewall.

4. The article of footwear of claim 1 wherein said replaceable inner sole defines a support region having a thickness in a range between ⅛ inch and ¾ inch.

5. The article of footwear of claim 4 wherein said replaceable inner sole defines a support region having a thickness greater than ½ inch.

6. The article of footwear of claim 5 wherein said support region is disposed in said cavity portion at a position to support a heel of the wearer's foot.

7. The article of footwear of claim 5 wherein said support region is disposed in said cavity portion at a position to support an arch of the wearer's foot.

8. The article of footwear of claim 5 wherein said support region is disposed in said cavity portion at a position to support a metatarsal region of the wearer's foot.

9. The article of footwear of claim 1 wherein an upper surface of said replaceable inner sole defines a plurality of discrete raised protuberances for orthotic support of an undersurface region of the wearer's foot.

10. The article of footwear of claim 1 wherein said replaceable inner sole comprises a cushioning layer.

11. The article of footwear of claim 1 wherein said replaceable inner sole comprises a perspiration-absorbent layer.

* * * * *